US008091484B2

(12) United States Patent
Sugimoto

(10) Patent No.: US 8,091,484 B2
(45) Date of Patent: Jan. 10, 2012

(54) CARRIAGE-TYPE CONVEYANCE SYSTEM

(75) Inventor: Katsuhiro Sugimoto, Shiga (JP)

(73) Assignee: Daifuku Co., Ltd. (JP)

( * ) Notice: Subject to any disclaimer, the term of this patent is extended or adjusted under 35 U.S.C. 154(b) by 324 days.

(21) Appl. No.: 12/377,286

(22) PCT Filed: Mar. 17, 2008

(86) PCT No.: PCT/JP2008/054849

§ 371 (c)(1),
(2), (4) Date: Feb. 12, 2009

(87) PCT Pub. No.: WO2008/120565

PCT Pub. Date: Oct. 9, 2008

(65) Prior Publication Data

US 2010/0218698 A1 Sep. 2, 2010

(30) Foreign Application Priority Data

Mar. 27, 2007 (JP) ..... 2007-081002

(51) Int. Cl.
*E01B 25/22* (2006.01)

(52) U.S. Cl. ..... 104/106

(58) Field of Classification Search ..... 104/88.01, 104/96, 106, 126–128
See application file for complete search history.

(56) References Cited

U.S. PATENT DOCUMENTS 2,511,316 A * 6/1950 Cody ..... 104/44
6,622,635 B2 * 9/2003 Lund ..... 104/88.01

FOREIGN PATENT DOCUMENTS

| | | |
|---|---|---|
| JP | H05-39029 | 2/1993 |
| JP | H08-002407 | 1/1996 |
| JP | 2004-299538 | 10/2004 |
| JP | 2006-241686 | 9/2006 |

* cited by examiner

*Primary Examiner* — Joe Morano, IV
*Assistant Examiner* — R. J. McCarry, Jr.
(74) *Attorney, Agent, or Firm* — St. Onge Steward Johnston & Reens LLC

(57) ABSTRACT

The present invention makes it easy to employ a floor surface aisle crossing a conveyance path in a conveyance system using a conveyance carriage 1 which travels on guide rails 7*a* and 7*b* laid on a floor surface 6 along the conveyance path, wherein at an aisle crossing section 14 in the conveyance path that the aisle on the floor surface crosses, a pit 15 is provided by digging down into the floor surface 6, and inside this pit 15, elevating guide rails 16*a* and 16*b* movable vertically parallel between a raised level at which the elevating guide rails connect the guide rails 7*a* and 7*b* before and after the pit 15 and a lowered level at which the upper surfaces of the elevating guide rails become flush with the floor surface 6 are disposed, and over the pit 15, a floor member 18 is laid so as to be flush with or substantially flush with the floor surface 8 while leaving elevating apertures for the elevating guide rails 16*a* and 16*b*.

6 Claims, 13 Drawing Sheets

(A)
(B)
7b
8
39a
39b
36
40a
40b
33
31
30
20A
20B
32
27
22
26
16b
25
18
21
37
38
19B
23

CARRIAGE-TYPE CONVEYANCE SYSTEM

TECHNICAL FIELD

The present invention relates to a carriage-type conveyance system using a conveyance carriage which travels on guide rails laid on a floor surface along a conveyance path.

BACKGROUND ART

In such a carriage-type conveyance system, when a floor surface aisle crossing section is included in the conveyance path, generally, to allow a vehicle, etc., traveling on the floor surface aisle crossing section to safely and easily get over the guide rails on the conveyance path side, a crossing aisle floor member is laid to be flush with the upper surfaces of the guide rails and slopes for eliminating level differences from the floor surface are formed on both ends of the crossing aisle floor member although patent documents disclosing this construction cannot be presented.

DISCLOSURE OF THE INVENTION

Problem to be Solved by the Invention

As described above, in the conventional construction in which a crossing aisle floor member having slopes on both ends is laid on the floor surface, not only is extra labor required to move a handcart or the like on the crossing aisle but also the safety is lowered in comparison with a flat floor surface on which no guide rails are laid.

Means for Solving the Problem

An object of the present invention is to provide a carriage-type conveyance system which can solve the conventional problem described above, and a carriage-type conveyance system according to a first aspect which uses, shown with the reference numerals in parentheses of the embodiment described later, a conveyance path formed by guide rails (7*a* and 7*b*) laid on a floor surface and a conveyance carriage (1) which travels on the guide rails (7*a* and 7*b*), and is provided with an aisle crossing section (14) which an aisle (13) on the floor surface crosses in the conveyance path, includes a pit (15); elevating guide rails (16*a* and 16*b*), and elevating drive devices (19A and 19B), wherein the pit (15) is formed by digging down into the floor surface (6) of the aisle crossing section (14) and is covered by a floor member (18) laid to be flush with the floor surface (6), the elevating guide rails (16*a* and 16*b*) are disposed inside the pit (15) movably vertically parallel between a raised level at which they connect the guide rails (7*a* and 7*b*) before and after the pit (15) and a lowered level at which their upper surfaces are flush with the floor surface (6), and the elevating drive devices (19A and 19B) elevate the elevating guide rails (16*a* and 16*b*) between the raised level and the lowered level, and in the floor member (18), elevating apertures (17) for the elevating guide rails (16*a* and 16*b*) are made.

To carry out the present invention constructed as described above, in detail, as described in a second aspect, it is possible that the conveyance carriage (1) is provided with at least four guided portions (3*a* through 3*d*) at appropriate intervals in the traveling direction, and on the conveyance paths before and after the aisle crossing section (14), conveyance carriage guide rails (8) which engage with the guided portions (3*a* through 3*d*) are laid so that at least two of the guided portions (3*a* through 3*d*) always engage with the conveyance carriage guide rails (8) when the conveyance carriage (1) passes through the aisle crossing section (14).

As described in a third aspect, in the conveyance path, a carriage stopper (39*a*) and a switching means (46) are provided parallel, and the carriage stopper (39*a*) is provided on at least the upstream side of the conveyance carriage traveling direction of the aisle crossing section (14), and is freely switched between a working posture in which the carriage stopper stops the conveyance carriage (1) before the elevating guide rail (16*a*, 16*b*) and a nonworking posture in which it allows the conveyance carriage (1) to pass through, and the switching means (46) switches the carriage stopper (39*a*) into the working posture only when the elevating guide rail (16*a*, 16*b*) is at the lowered level in conjunction with the vertical movements of the elevating guide rail (16*a*, 16*b*).

Further, as described in a fourth aspect, it is possible that the elevating drive devices (19A and 19B) are constituted by elevating support means (20A and 20B) and drive means (21), and the elevating support means (20A and 20B) is disposed at least at two positions before and after the elevating guide rails (16*a* and 16*b*) in the longitudinal direction, and is constituted each by cam rails (23) provided on either a movable body (22) movable in the longitudinal direction of the corresponding elevating guide rail (16*a*, 16*b*) below the elevating guide rail (16*a*, 16*b*) or the elevating guide rail (16*a*, 16*b*), and a cam follower roller (24) provided on the other, and the drive means (21) is constructed so as to reciprocate the movable bodies (22) of the elevating support means (20A and 20B) in conjunction with each other. In this case, as described in a fifth aspect, the elevating guide rail (16*a*, 16*b*) is provided with an elevating guide unit (33) parallel, and a pair of left and right cam follower rollers (24) are axially supported concentrically on both left and right sides of the elevating guide rail (16*a*, 16*b*), and the elevating guide unit (33) is provided at least two positions before and after in the longitudinal direction of the elevating guide rail (16*a*, 16*b*), and has a pair of left and right slide guides (36) sandwiching the elevating guide rail (16*a*, 16*b*), and each elevating support means (20A, 20B) is provided with elevating guide rollers (30) and elevating guide members (32), and the pair of elevating guide rollers (30) are axially supported on the left and right concentrically with the cam follower rollers (24) on the outer sides of the pair of left and right cam follower rollers (24), a pair of left and right elevating guide members (32) are provided parallel so that the pair of left and right guide rollers (30) engage with these movably vertically, and the movable body (22) is disposed between the pair of left and right elevating guide members (32), and on the movable body (22), a pair of left and right cam rails (23) which support the pair of left and right cam follower rollers (24), respectively, are laid.

Effects of the Invention

According to the carriage-type conveyance system of the present invention described in the first aspect, although the conveyance carriage can be made to smoothly travel at a predetermined level via the elevating guide rails raised to the raised level when the conveyance carriage passes through the aisle crossing section, the elevating guide rails are lowered to the lowered level when the conveyance carriage does not travel on the aisle crossing section, and accordingly, a flat crossing aisle flush with the floor surface around it is formed by the floor member covering the pit and the upper surfaces of the elevating guide rails at the lowered level, so that a handcart, etc., can be safely moved on this crossing aisle without extra labor.

According to the construction described in the second aspect, even without using flanged wheels that engage with guide rails as wheels of the conveyance carriage, the orientation of the conveyance carriage to pass through the crossing aisle can be reliably restricted and the conveyance carriage can be prevented from unexpectedly deviating from the conveyance path when passing through the crossing aisle.

According to the construction described in the third aspect, there is no possibility that the conveyance carriage is made to enter the aisle crossing section by mistake in the state that the elevating guide rails disposed on the aisle crossing section are lowered to the lowered level, so that the safety can be increased.

Further, according to the construction described in the fourth aspect, it is only required that below the elevating guide rails lowered to the lowered level, a space which allows the movable bodies having cam rails or cam follower rollers to move in the longitudinal direction of the elevating guide rails is secured, so that the depth of the pit that must be formed by digging down into the floor surface at the aisle crossing section can be made comparatively shallow. In this case, according to the construction described in the fifth aspect, the elevating guide rails can be smoothly moved vertically parallel while movements and falling in the left and right lateral direction and movements in the longitudinal direction of the elevating guide rails are reliably prevented, and the cam follower rollers and the elevating guide rollers can be axially supported by a common support shaft, so that the number of parts can be reduced and the system can be constructed inexpensively.

DESCRIPTION OF THE REFERENCE NUMERALS

Figure 1:
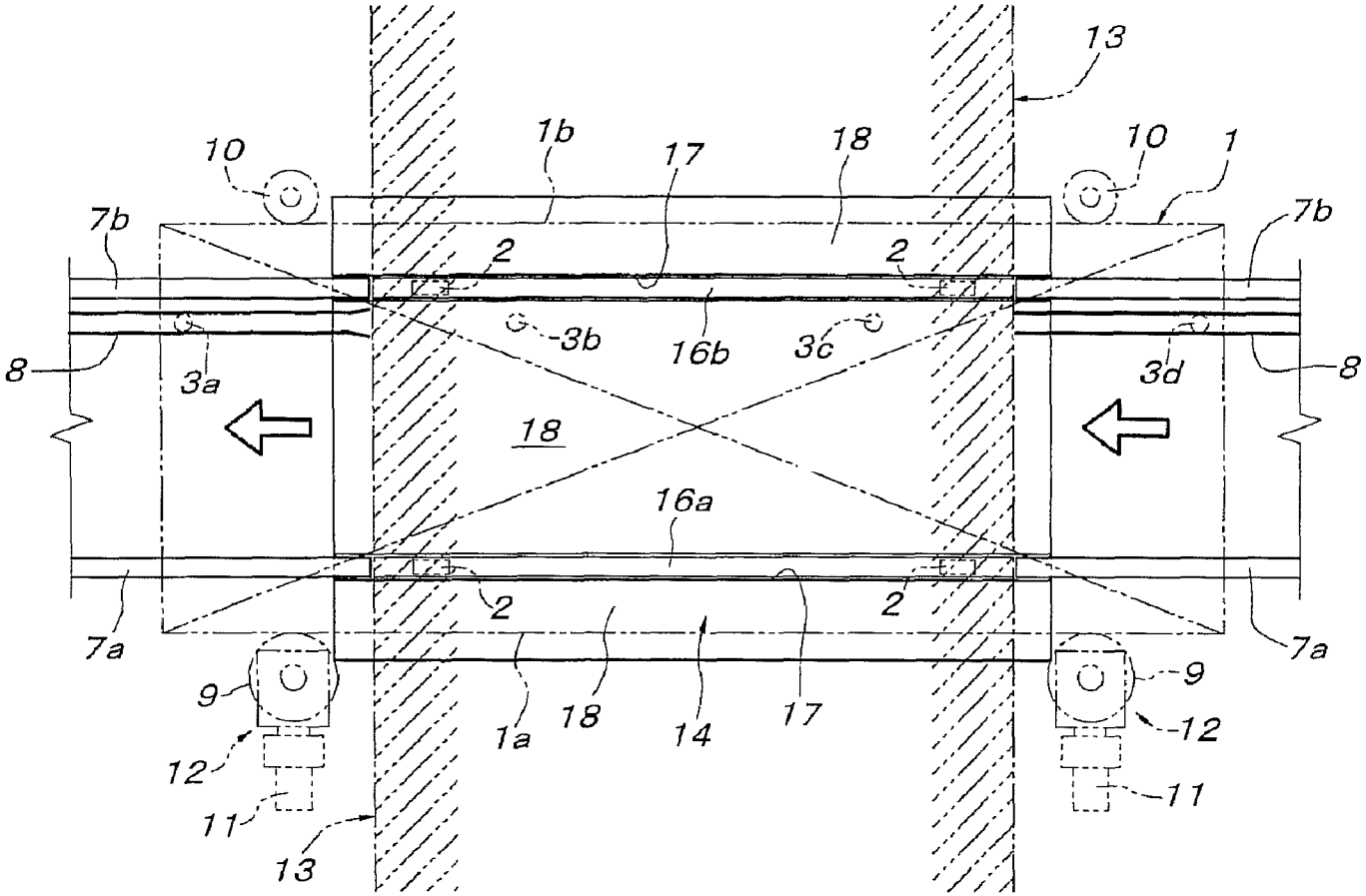
FIG. 1 is a schematic plan view showing an entire construction of an aisle crossing section.

1: conveyance carriage
2: wheel
3*a*-3*d*: vertical axis roller
6: floor surface
7*a*, 7*b*: conveyance carriage supporting guide rail
8: conveyance carriage guiding groove-shaped guide rail
12: frictional driving means
13: floor surface aisle
14: aisle crossing section
15: pit
16*a*, 16*b*: elevating guide rail
17: aperture
18: floor member
19A, 19B: elevating drive device
20A, 20B: elevating support means
21: drive means
22: plate-shaped movable body
23: cam rail
24, 44: cam follower roller
25: substrate
26: slide guide rail
27: slide block
28, 41: bearing member
29, 42: support shaft
30: elevating guide roller
31: slot
32: elevating guide member
33: elevating guide unit
35: slip member
36: slide guide plate
37: cylinder unit
38: joint rod
39*a*, 39*b*: carriage stopper
40*a*, 40*b*: mount
45: operating plate
46: switching means

BEST MODE FOR CARRYING OUT THE INVENTION

Figure 2:
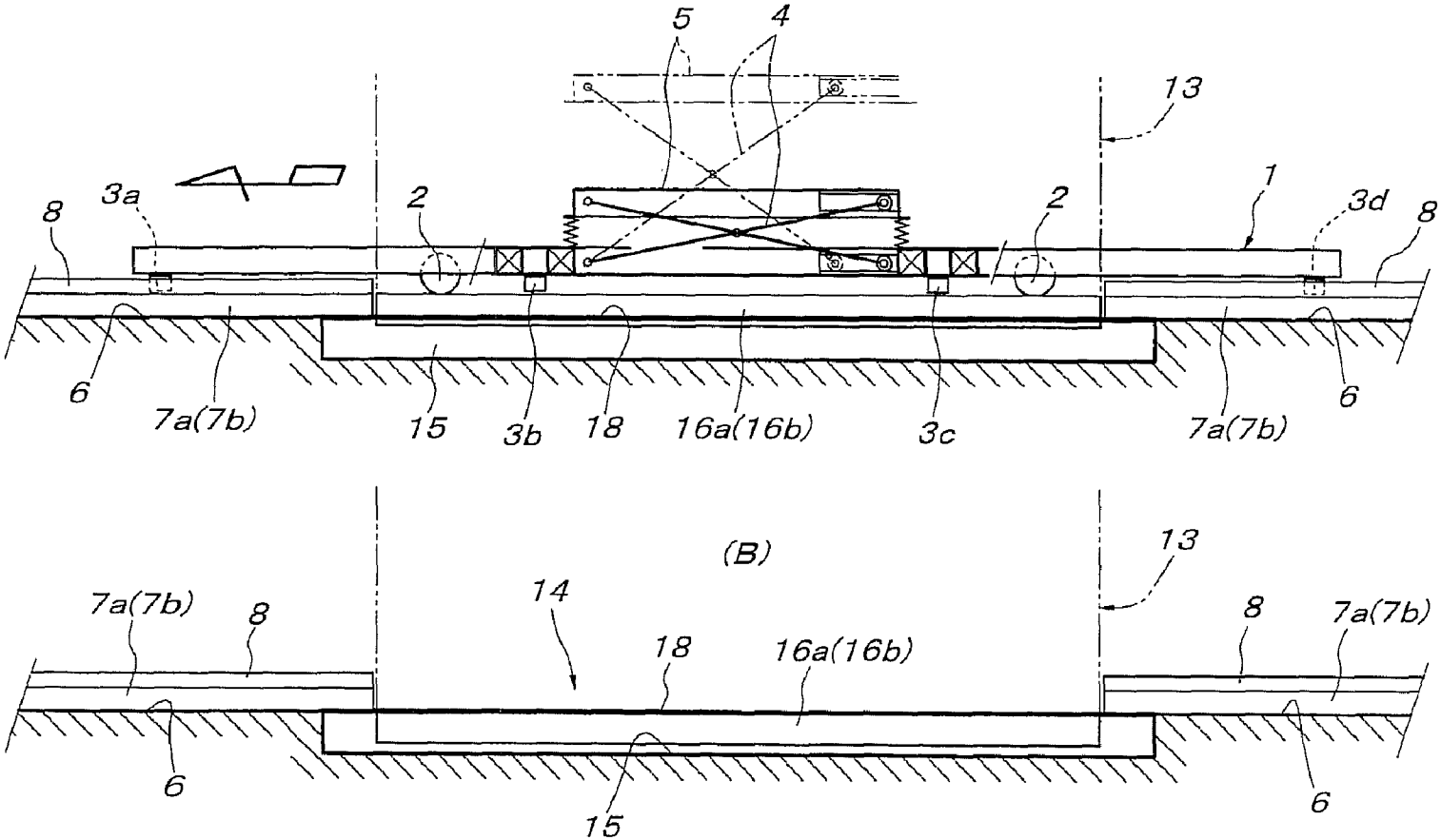
FIG. 2A is a schematic longitudinal sectional side view showing a state when the conveyance carriage passes through the aisle crossing section.
FIG. 2B is a schematic longitudinal sectional side view showing a state when a crossing aisle is used.
Figure 3:
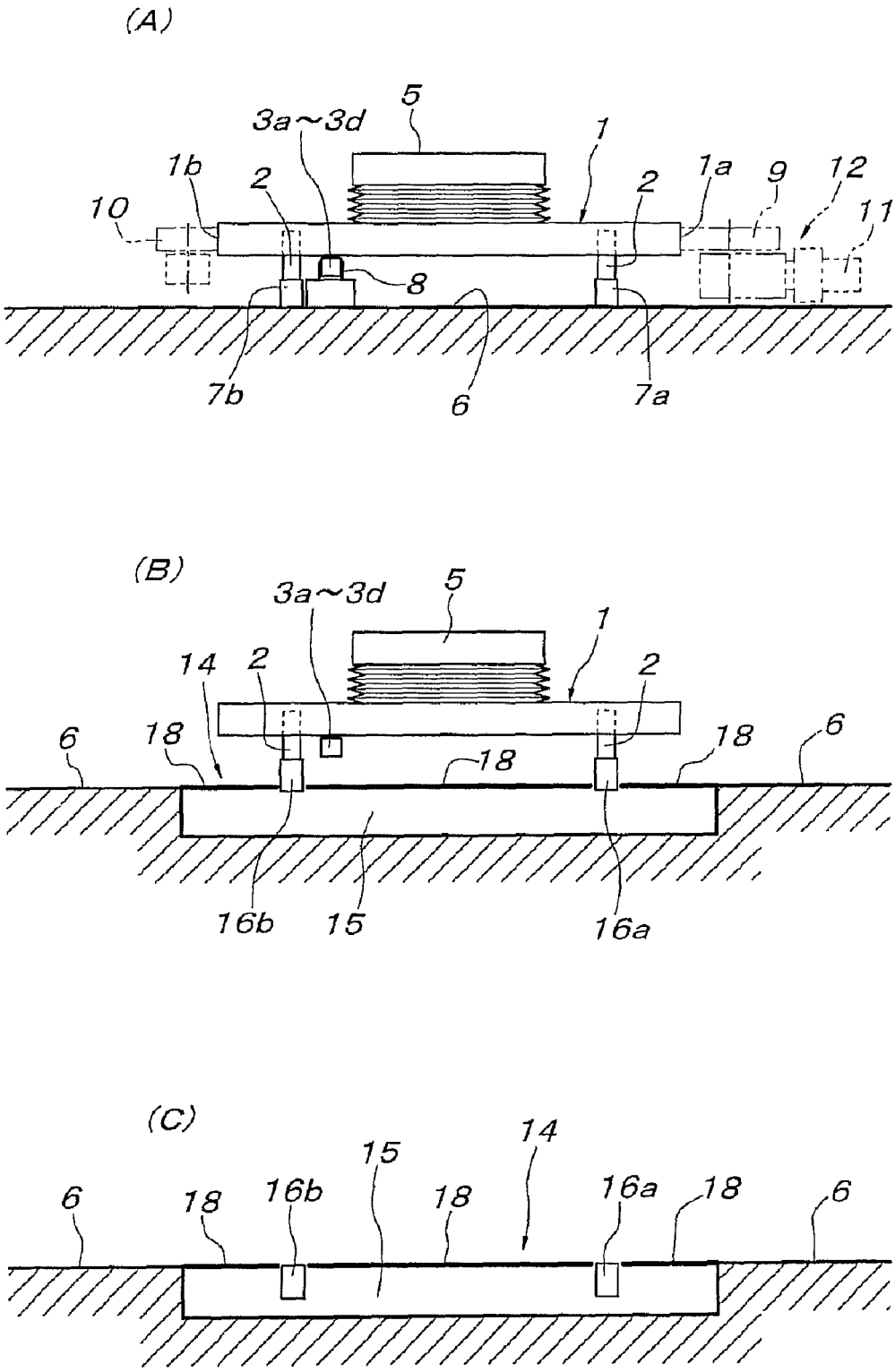
FIG. 3A is a schematic front view showing a conveyance carriage when traveling on a conveyance path.
FIG. 3B is a schematic longitudinal sectional front view showing the conveyance carriage when traveling on the aisle crossing section.
FIG. 3C is a schematic longitudinal sectional front view showing a state when the crossing aisle is used.

Hereinafter, a detailed embodiment of the present invention will be described with reference to the accompanying drawings. In FIG. 1 through FIG. 3, the reference numeral 1 denotes a conveyance carriage which is provided with two front and rear pairs of left and right wheels 2 on the bottom and four vertical axis rollers 3*a* through 3*d* axially supported at appropriate intervals on a straight line parallel to a traveling direction, and an elevating rack 5 at an upper central portion which is supported so as to be elevated by a crosslink mechanism 4. This elevating rack 5 can be elevated by various conventionally known methods such as a motor driving method in which the crosslink mechanism 4 is raised and lowered by a motor-driven screw mechanism or a cam rail method in which the elevating rack 5 is raised by pushing-up elevating cam follower rollers interlocked with rising and lowering movements of the crosslink mechanism 4 by cam rails laid on the floor surface side and the elevating rack 5 is lowered by gravity.

On the traveling path of the conveyance carriage 1, that is, on the floor surface 6 as the conveyance path, a pair of left and right guide rails 7*a* and 7*b* which support wheels 2 so as to allow these to roll freely, and conveyance carriage guiding groove-shaped guide rails 8 consisting of a pair of left and right rail members in which four vertical axis rollers 3*a* through 3*d* arranged in series fit with play remaining are laid. The four vertical axis rollers 3*d* through 3*d* arranged in series are disposed at positions near both front and rear ends and two intermediate positions of the conveyance carriage 1 on an imaginary straight line in the front and rear direction (traveling direction) adjacent to the inner side of left or right wheels 2. The traveling drive method for this conveyance carriage 1 is not especially limited, and for example, as shown by the imaginary lines in FIG. 1 and FIG. 3A, a frictional driving method can be used in which a frictional drive means 12 consisting of a frictional driving roller 9 and a backup roller 10 which sandwich the parallel left and right side surfaces 1*a* and 1*b* of the conveyance carriage 1 and a motor 11 which drives and rotates the frictional driving roller 9 is provided at positions at appropriate intervals on the conveyance path.

In the conveyance path of the conveyance carriage 1, an aisle 13 is provided on the floor surface to cross the conveyance path. On this aisle crossing section 14 in the conveyance path, the guide rails 7*a* and 7*b* and the conveyance carriage guide rails 8 are not laid. The width of the crossing aisle 13 is shorter than the distance between two vertical axis rollers 3*a* and 3*d* on both ends among the four vertical axis rollers 3*a* through 3*d* arranged in series but are longer than the distance between the two middle vertical axis rollers 3*b* and 3*c* so that, when the conveyance carriage 1 passes through the aisle crossing section 14, fitting with play remaining of only one vertical axis roller 3*a* at the front end or one vertical axis roller 3*d* at the rear end among the four vertical axis rollers 3*a* through 3*d* arranged in series in the conveyance carriage guiding groove-shaped guide rails 8 is prevented, that is, at least two vertical axis rollers among the four vertical axis rollers 3*a* through 3*d* in series always fit with play remaining in either one of the conveyance carriage guiding groove-shaped guide rails 8 before and after the aisle crossing section 14 or fit with play remaining across both conveyance carriage guiding groove-shaped guide rails 8 before and after the aisle crossing section 14.

At the aisle crossing section 14 in the conveyance path of the conveyance carriage 1, a pit 15 is provided by digging down into the floor surface 6, and inside this pit 15, elevating guide rails 16*a* and 16*b* which connect the guide rails 7*a* and 7*b* before and after the aisle crossing section 14 are provided. These elevating guide rails 16*a* and 16*b* are constructed so as to freely move vertically parallel between a raised level at which they connect the guide rails 7*a* and 7*b* and a lowered level at which the upper surfaces of the elevating guide rails 16*a* and 16*b* are flush with the floor surface 6 as shown in FIG. 2A, FIG. 3B, and FIG. 3C. Over the pit 15, a floor member 18 flush with the floor surface 6 is laid via a mount (not shown) while leaving apertures 17 in which the elevating guide rails 16*a* and 16*b* move vertically.

Figure 13:
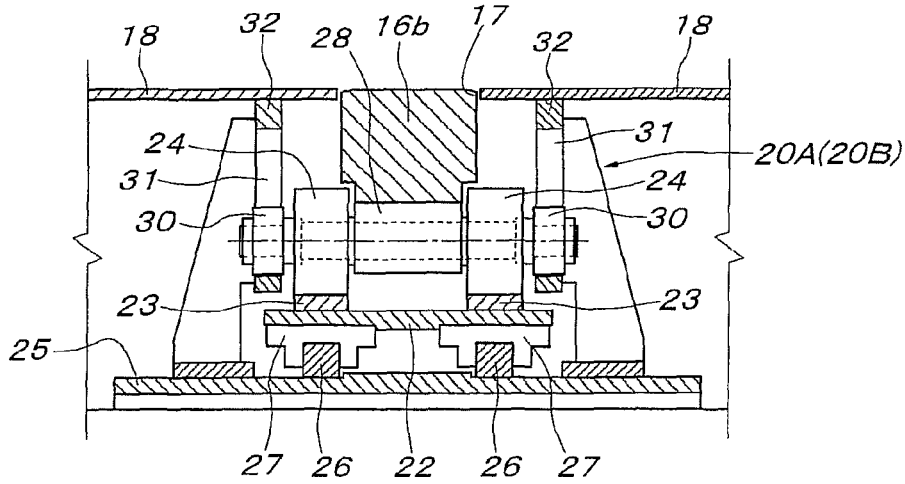
FIG. 13 is a longitudinal sectional front view of the main portion when the elevating guide rails are at the lowered level.
Figure 14:
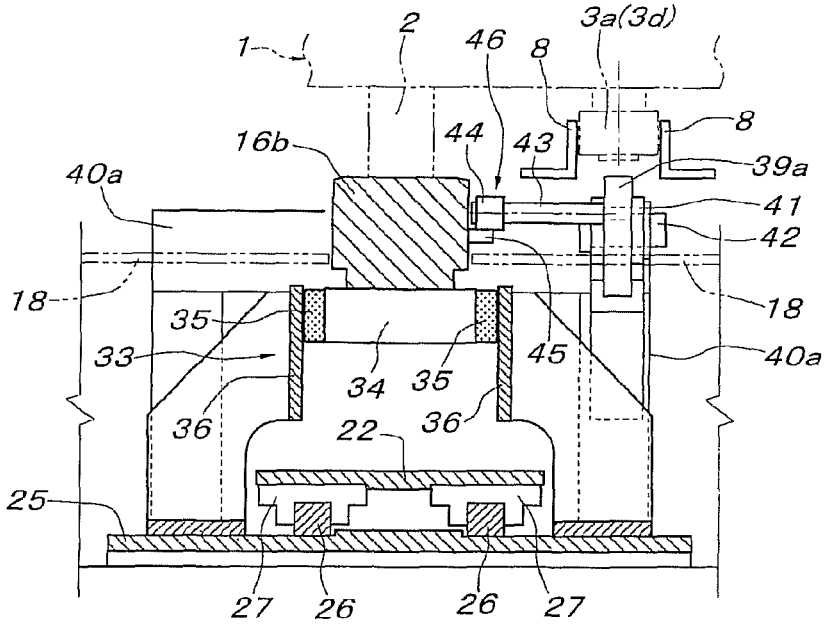
FIG. 14 is a longitudinal sectional front view of the main portion when the elevating guide rails are at the raised level and a carriage stopper is in a fallen-down nonworking posture.

Hereinafter, an embodiment of the elevating drive device of the elevating guide rail 16*a*, 16*b* will be described with reference to FIG. 4 through FIG. 13. The elevating drive device 19A of the elevating guide rail 16*a* and the elevating drive device 19B of the elevating guide rail 16*b* have the same structure, and FIG. 5 through FIG. 13 show the elevating drive device 19B of the elevating guide rail 16*b*. These elevating drive devices 19A and 19B include drive means 21 and elevating support means 20A and 20B disposed at two positions near both longitudinal ends of the elevating guide rails 16*a* and 16*b*. The elevating support means 20A and 20B have the same structure, and each includes a plate-shaped movable body 22 disposed below the elevating guide rail 16*a*, 16*b*, a pair of left and right cam rails 23 provided on the plate-shaped movable body 22, and two front and rear pairs of left and right cam follower rollers 24 placed on the cam rails 23 so as to roll freely. As shown in FIG. 13 and FIG. 14, the plate-shaped movable body 22 is supported on the pair of left and right slide guide rails 26 on a substrate 25 laid on the bottom surface of the pit 15, movably in the longitudinal direction of the elevating guide rail 16*a*, 16*b* via slide blocks 27, and the pair of left and right cam rails 23 are disposed parallel to the elevating guide rail 16*a*, 16*b* on both left and right sides of the elevating guide rail 16*a*, 16*b*, and the pair of left and right cam follower rollers 24 are axially supported by a common support shaft 29 in a horizontal posture on both left and right sides of the bearing member 28 provided below the elevating guide rail 16*a*, 16*b*.

On the outer sides of the pair of left and right cam follower rollers 24, elevating guide rollers 30 are axially supported concentrically by using the common support shaft 29 axially supporting the cam follower rollers 24, and a pair of left and right elevating guide members 32 having vertical slots 31 in which the elevating guide rollers 30 fit with play remaining so as to roll and move vertically are attached onto the substrate 25 parallel to the elevating guide rail 16*a*, 16*b* on the outer sides of the pair of left and right cam rails 23.

Figure 15:
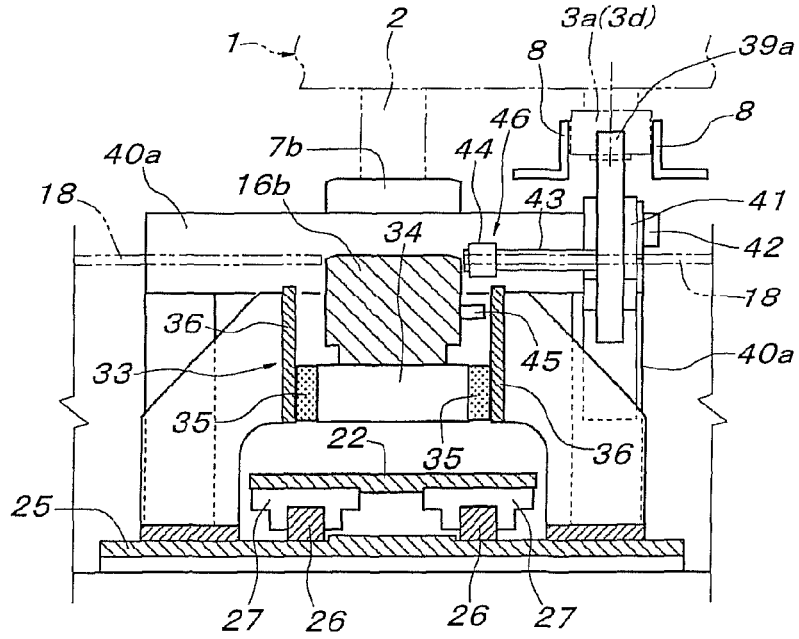
FIG. 15 is a longitudinal sectional front view of the main portion when the elevating guide rails are at the lowered level and the carriage stopper is in a standup working posture.

Parallel to the respective elevating support means 20A and 20B, elevating guide units 33 are provided. As shown in FIG. 14 and FIG. 15, these elevating guide units 33 include slip members 35 attached to both left and right sides of the elevating guide rail 16*a*, 16*b* via an attaching member attached to the lower side of the elevating guide rail 16*a*, 16*b*, and a pair of left and right slide guide plates 36 attached onto the substrate 25 so as to sandwich movably vertically the elevating guide rail 16*a*, 16*b* via the pair of left and right slip members 35.

Figure 4:
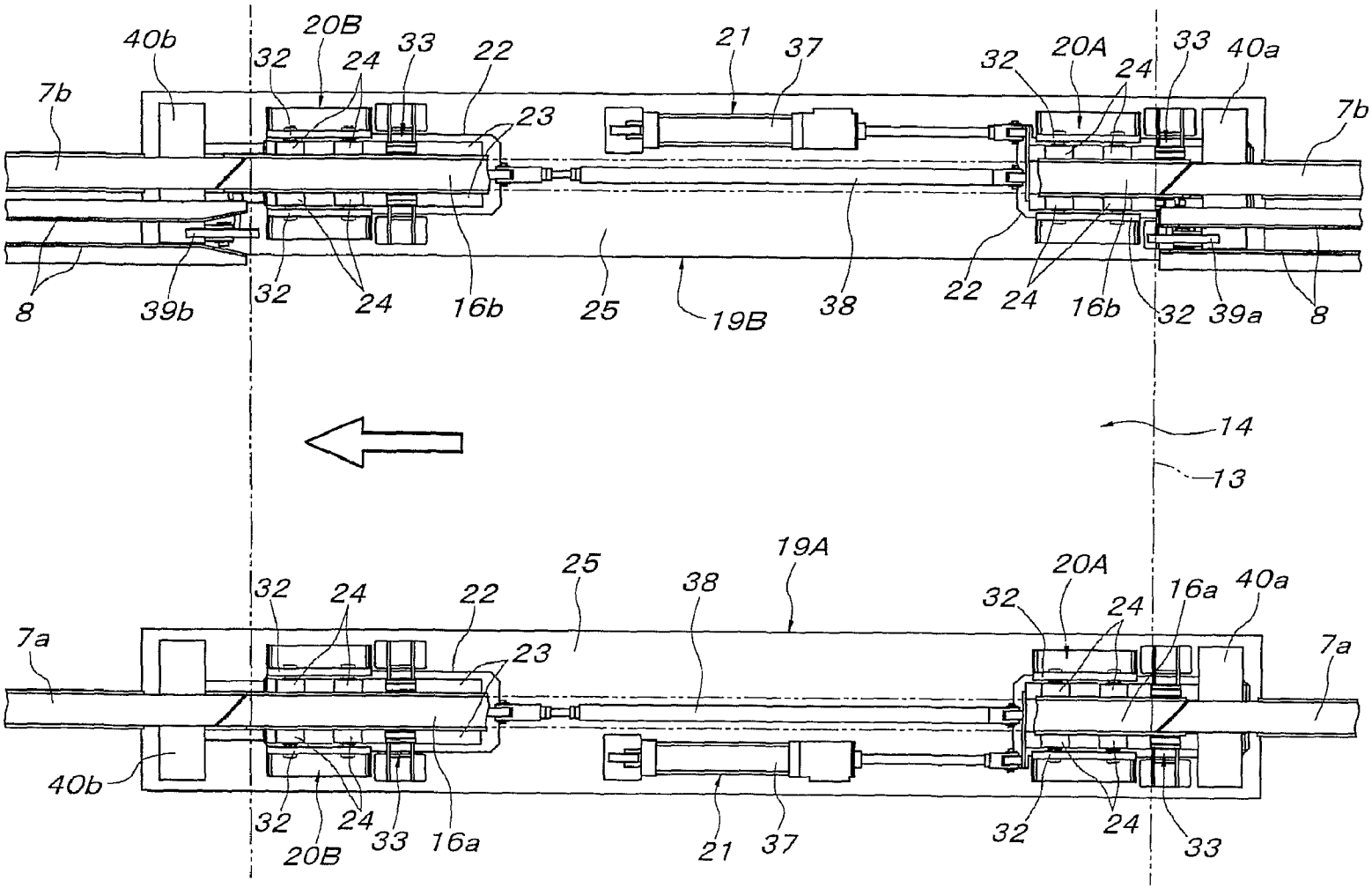
FIG. 4 is a plan view showing an elevating guide rail at a raised level and an elevating drive device for the elevating guide rail.
Figure 5:
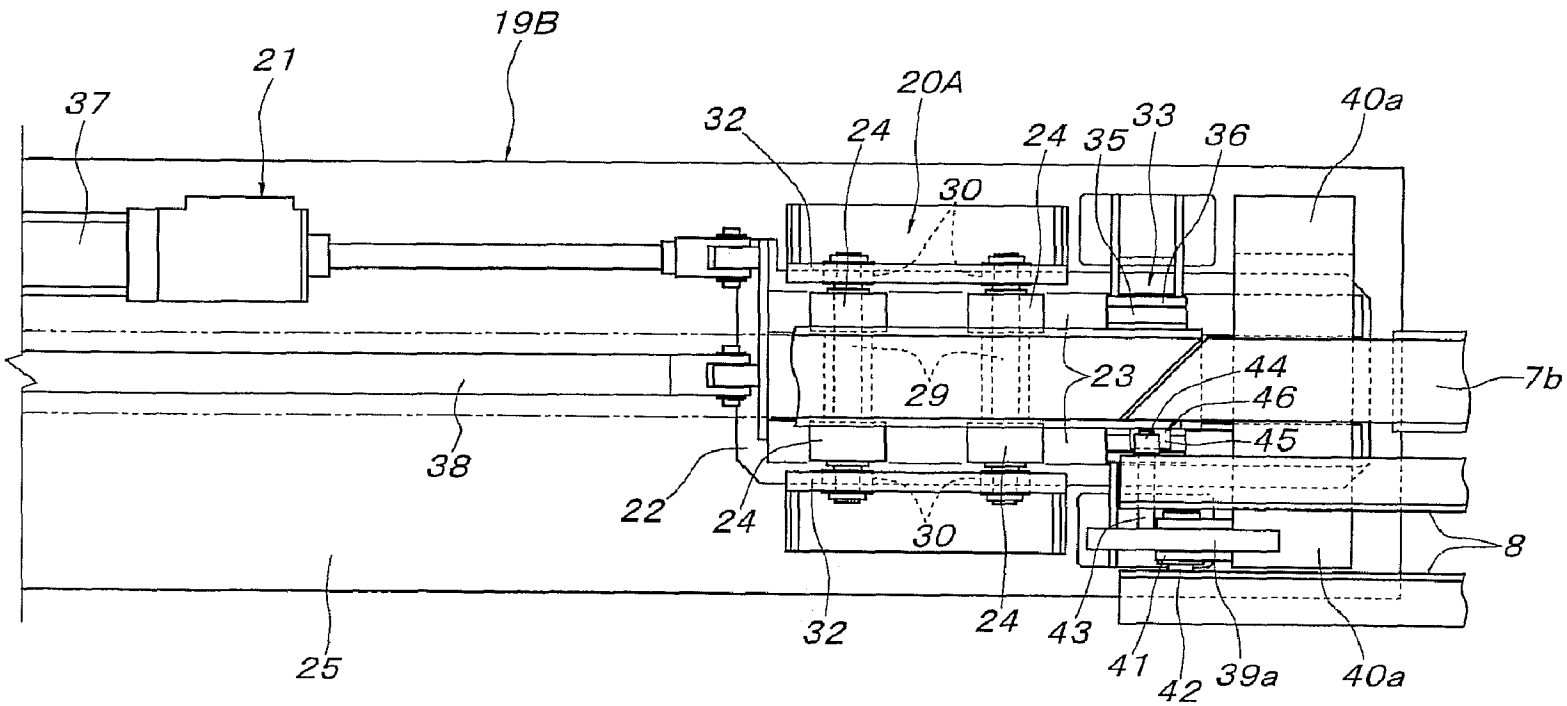
FIG. 5 is an enlarged plan view of a main portion of FIG. 4.
Figure 6:
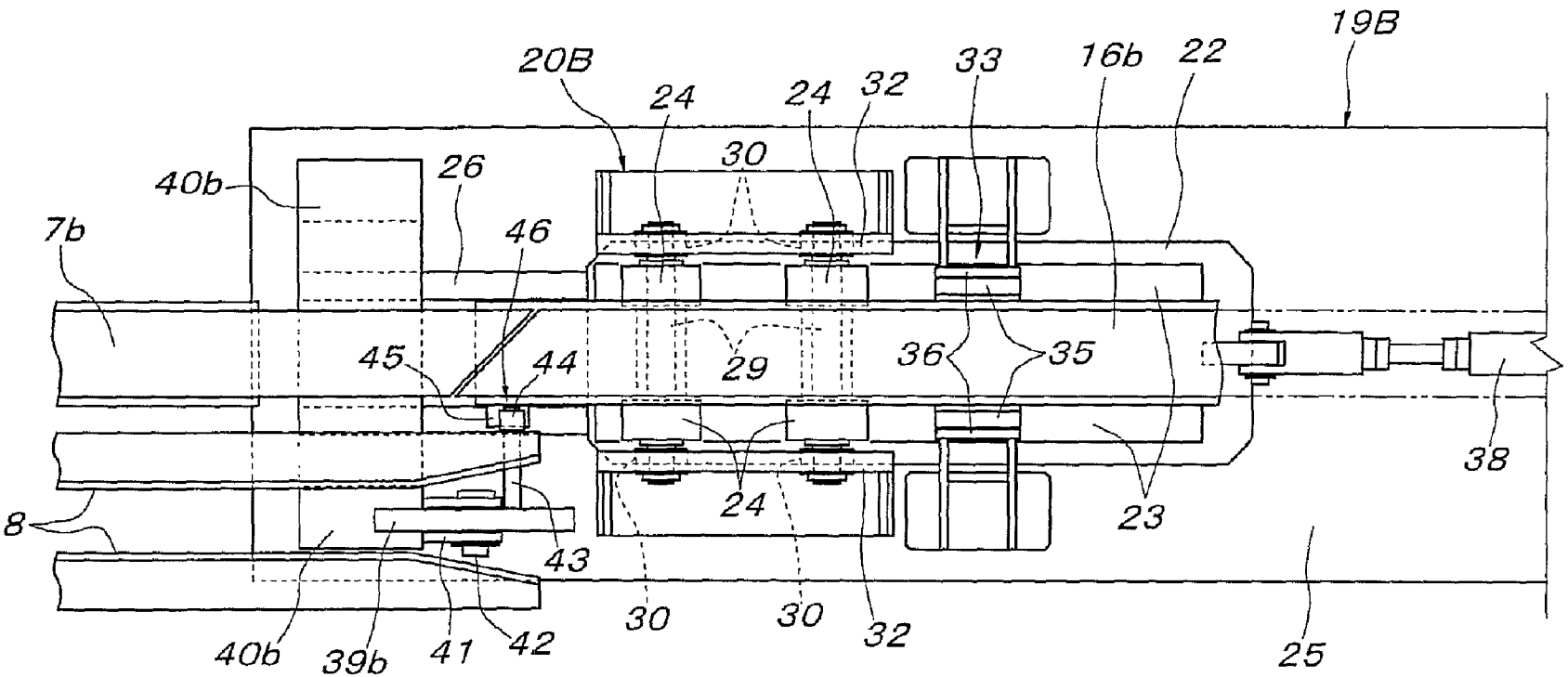
FIG. 6 is an enlarged plan view of another main portion of FIG. 4.
Figure 7:
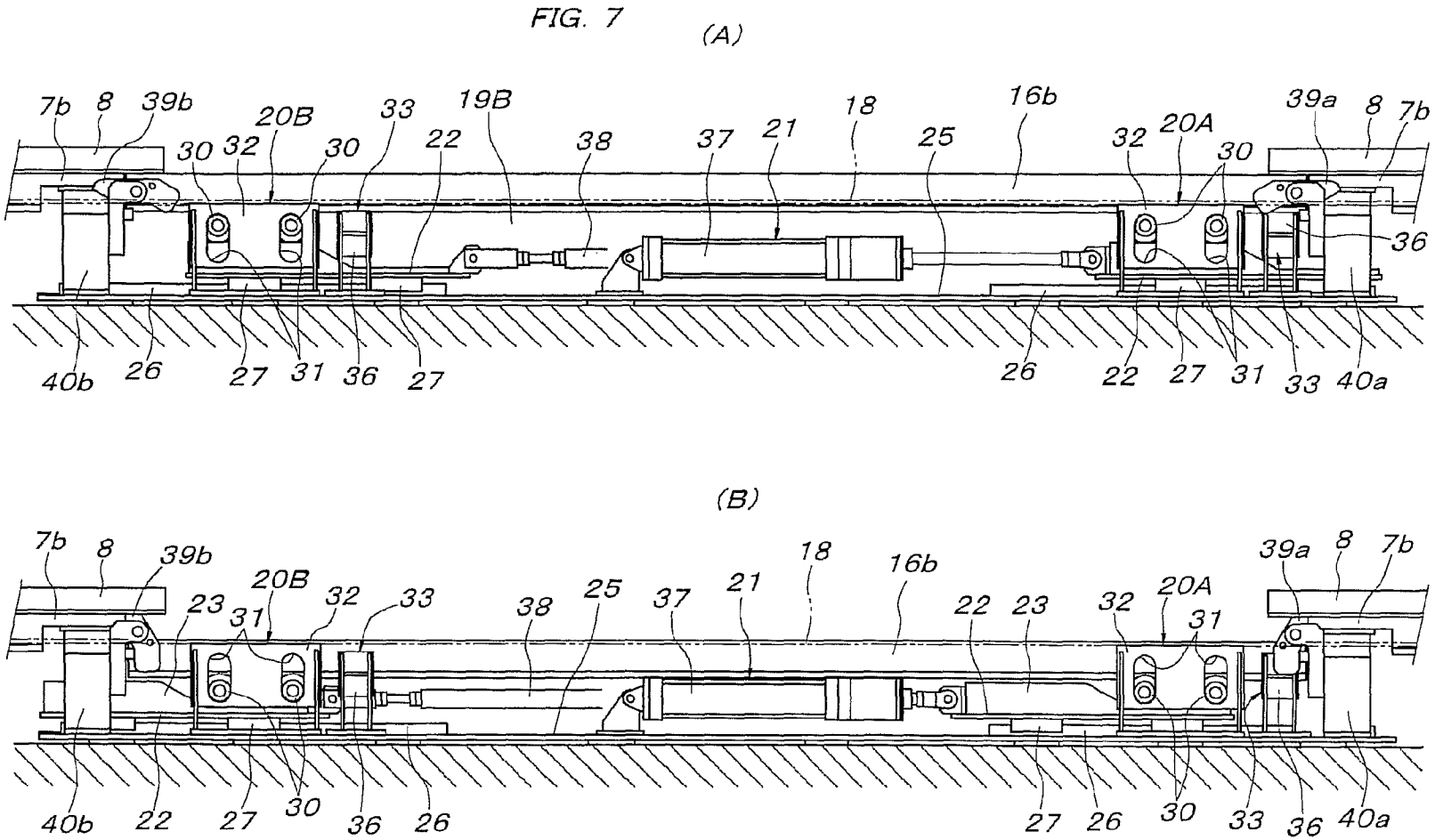
FIG. 7A is a side view of a main portion of FIG. 4.
FIG. 7B is a side view of the main portion in a state that the elevating guide rails are switched to the lowered level.

The drive means 21 consists of, as shown in FIG. 4, a cylinder unit 37 which is interposed between the plate-shaped movable body 22 and the substrate 25 of one elevating support means 20A and reciprocates the plate-shaped movable body 22 of the elevating support means 20A, and a joint rod 38 which interlocks and joins the plate-shaped movable body 22 of the elevating support means 20A and the plate-shaped movable body 22 of the other elevating support means 20B.

As shown in FIG. 4, the elevating support means 20A and 20B of one elevating drive device 19B are provided with carriage stoppers 39*a* and 39*b* parallel. In each elevating drive device 19A, 19B, as shown in FIG. 8 through FIG. 11, mounts 40*a* and 40*b* for supporting the ends of the guide rails 7*a* and 7*b* adjacent to the elevating guide rails 16*a* and 16*b* are stood on the substrates 25, and the carriage stoppers 39*a* and 39*b* are axially supported on bearing members 41 attached to the mounts 40*a* and 40*b* by support shafts 42 in left and right horizontal postures, and are constructed so as to swing vertically only between a standup working posture (see FIG. 10, FIG. 11, and FIG. 15) in contact with the vertical axis roller 3*a* (or 3*d*) moving within the conveyance carriage guiding groove-shaped guide rails 8 parallel to the guide rail 7*b* and a fallen-down nonworking posture that is fallen in a direction apart from the aisle crossing section 14 with respect to the standup working posture and allows the vertical axis rollers 3*a* through 3*d* to pass through (see FIG. 8, FIG. 9, and FIG. 14), and are urged into the standup working posture by gravity or a spring force. Further, as shown in FIG. 14 and FIG. 15, parallel to these carriage stoppers 39*a* and 39*b*, switching means 46 is provided. This switching means 46 consists of a cam follower roller 44 axially supported on the carriage stopper 39*a*, 39*b* via a projecting support shaft 43 in a left and right horizontal posture projecting to the side of the elevating guide rail 16*b* from the carriage stopper 39*a*, 39*b*, and an operating plate 45 which is attached to the side surface of the elevating guide rail 16*a*, 16*b* so as to switch the carriage stopper 39*a*, 39*b* from the standup working posture into the fallen-down nonworking posture via the cam follower roller 44 when the elevating guide rail 16*b* rises to the raised level.

In the above-described construction, the elevating guide rails 16*a* and 16*b* are prevented from falling in the left and right lateral direction by sandwiching the portions near both ends in the longitudinal direction by elevating guide units 33, and are prevented from moving in the longitudinal direction and are allowed to move only vertically by fitting, with play remaining, the elevating guide rollers 30 in slots 31 of the elevating guide members 32 of the elevating support means 20A and 20B. The cam rails 23 are formed so that the elevating guide rails 16*a* and 16*b* supported by the cam rails 23 move vertically parallel via the cam follower rollers 24 while maintaining their horizontal postures by actuating the cylinder units 37 of the drive means 21 of the elevating drive devices 19A and 19B and moving forward and rearward the cam rails 23 of both front and rear elevating support means 20A and 20B synchronously via the plate-shaped movable bodies 22. Specifically, the cam rail 23 is provided with a low-level horizontal support surface and a high level horizontal support surface for selectively supporting the cam follower roller 24, and according to the movements of the cam rails 23 of both front and rear elevating support means 20A and 20B, the cam follower rollers 24 on the sides of the elevating guide rails 16*a* and 16*b* shift from one to the other of the low-level horizontal support surfaces and the high-level horizontal support surfaces of the cam rails 23 simultaneously.

Hereinafter, a usage will be described. Until the conveyance carriage 1 traveling on the conveyance path approaches the aisle crossing section 14, the elevating guide rails 16*a* and 16*b* are lowered to the lowered level as shown in FIG. 2B, FIG. 3C, FIG. 7B, FIG. 10, FIG. 11, FIG. 13, and FIG. 15. Specifically, the cam rails 23 of both front and rear elevating support means 20A and 20B of the elevating drive devices 19A and 19B are slid to the downstream side of the aisle crossing section 14 by the drive means 21 (cylinder units 37) and switched into a state that the low-level horizontal support surfaces of the cam rails 23 support the cam follower rollers 24. As a result, the elevating guide rails 16*a* and 16*b* lower from the raised level to the lowered level, and the upper surfaces of the elevating guide rails 16*a* and 16*b* become flush with the surface of the floor member 18 covering the pit 15, that is, the floor surface 6. In this state, the upper surface of the aisle crossing section 14 becomes a flat surface flush with the floor surface 6 of the crossing aisle 13, so that a handcart, etc., can be safely and smoothly moved on the crossing aisle 13.

In the state that the elevating guide rails 16*a* and 16*b* are switched to the lowered level as described above, as shown in FIG. 10, FIG. 11, and FIG. 15, the operating plates 45 of the switching means 46 of the carriage stoppers 39*a* and 39*b* are lowered together with the elevating guide rails 16*a* and 16*b* and spaced downward from the cam follower rollers 44 of the carriage stoppers 39*a* and 39*b*, so that these carriage stoppers 39*a* and 39*b* are switched into a standup working posture by the urging force. Therefore, even if the conveyance carriage 1 is made to enter the aisle crossing section 14 by mistake in the state that the elevating guide rails 16*a* and 16*b* are lowered to the lowered level as described above, the forefront vertical axis roller 3*a* among the vertical axis rollers 3*a* through 3*d* of the conveyance carriage 1 is received by the carriage stopper 39*a*, 39*b* entering inside the terminal end of the conveyance carriage guiding groove-shaped guide rail 8 and the conveyance carriage 1 is prevented from entering the aisle crossing section 14. When the traveling direction of the conveyance carriage 1 is limited to one direction, only the carriage stopper 39*a* on the upstream side of the aisle crossing section 14 may be provided.

Figure 8:
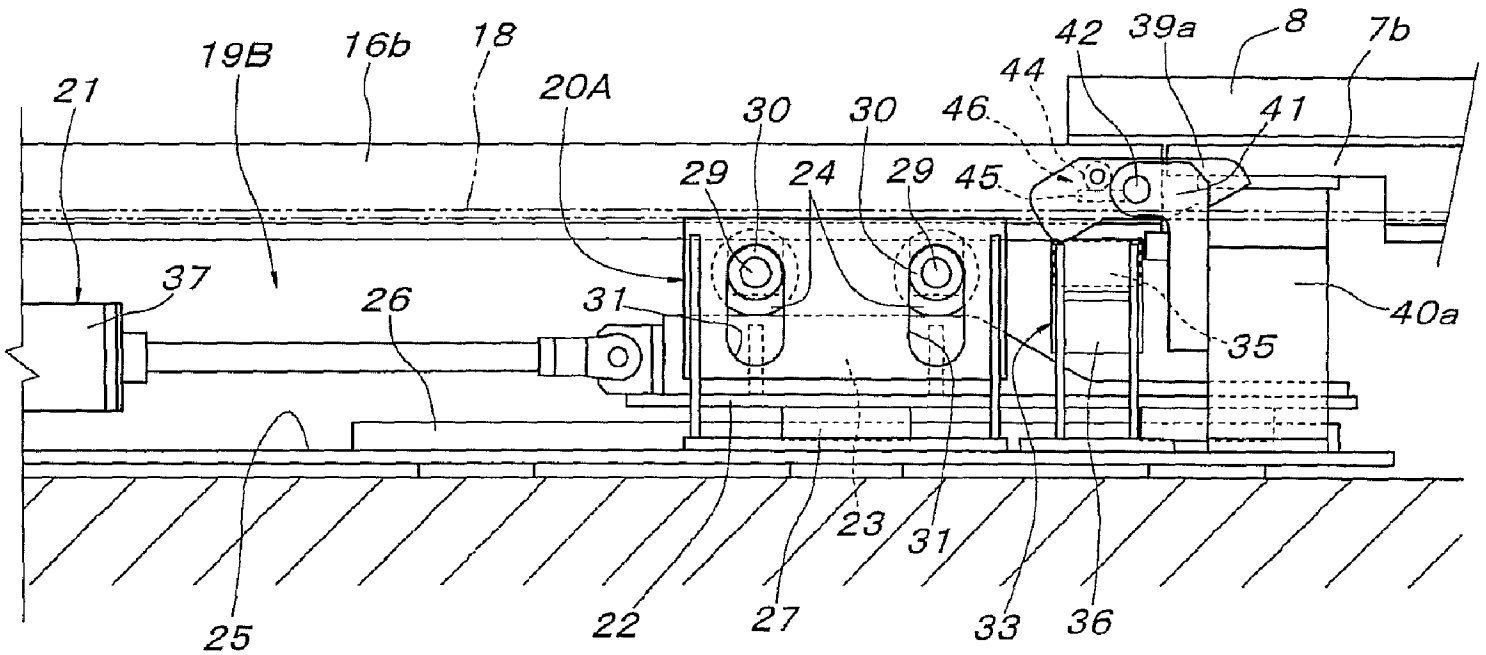
FIG. 8 is an enlarged side view of a main portion of FIG. 7A.
Figure 9:
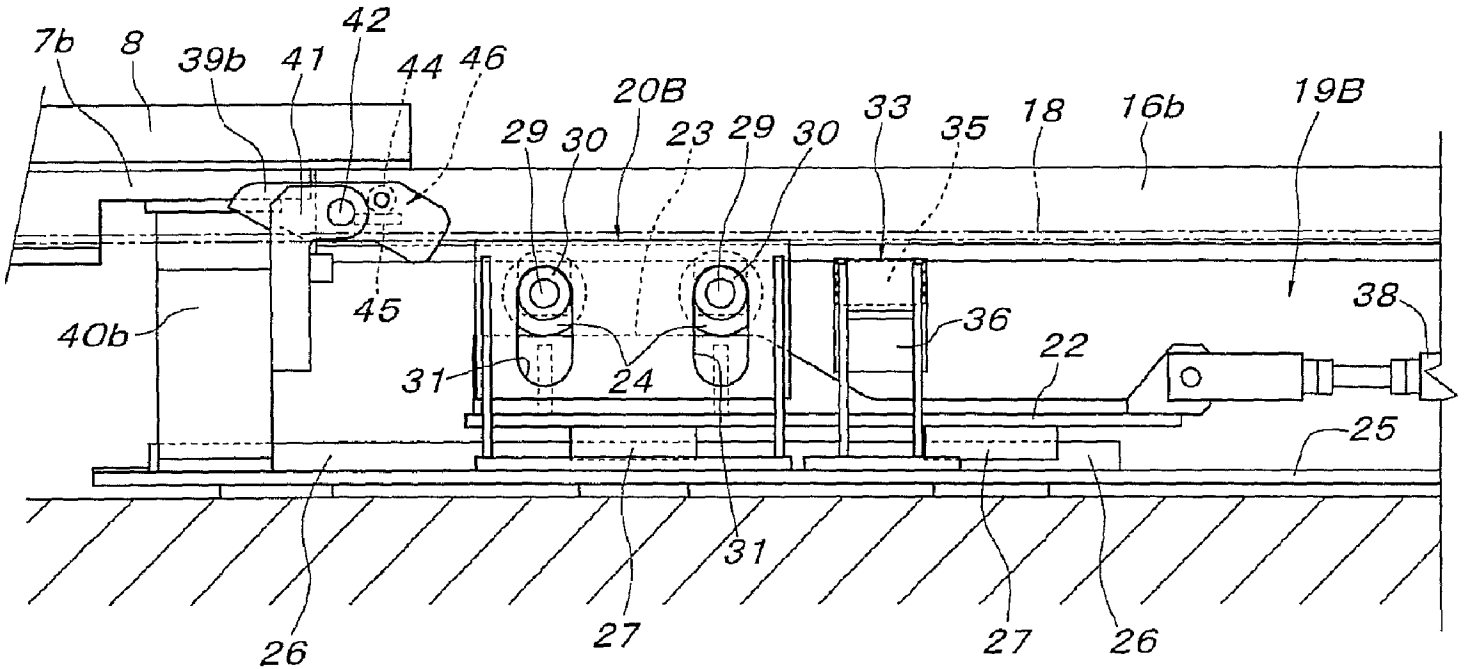
FIG. 9 is an enlarged side view of another main portion of FIG. 7A.
Figure 10:
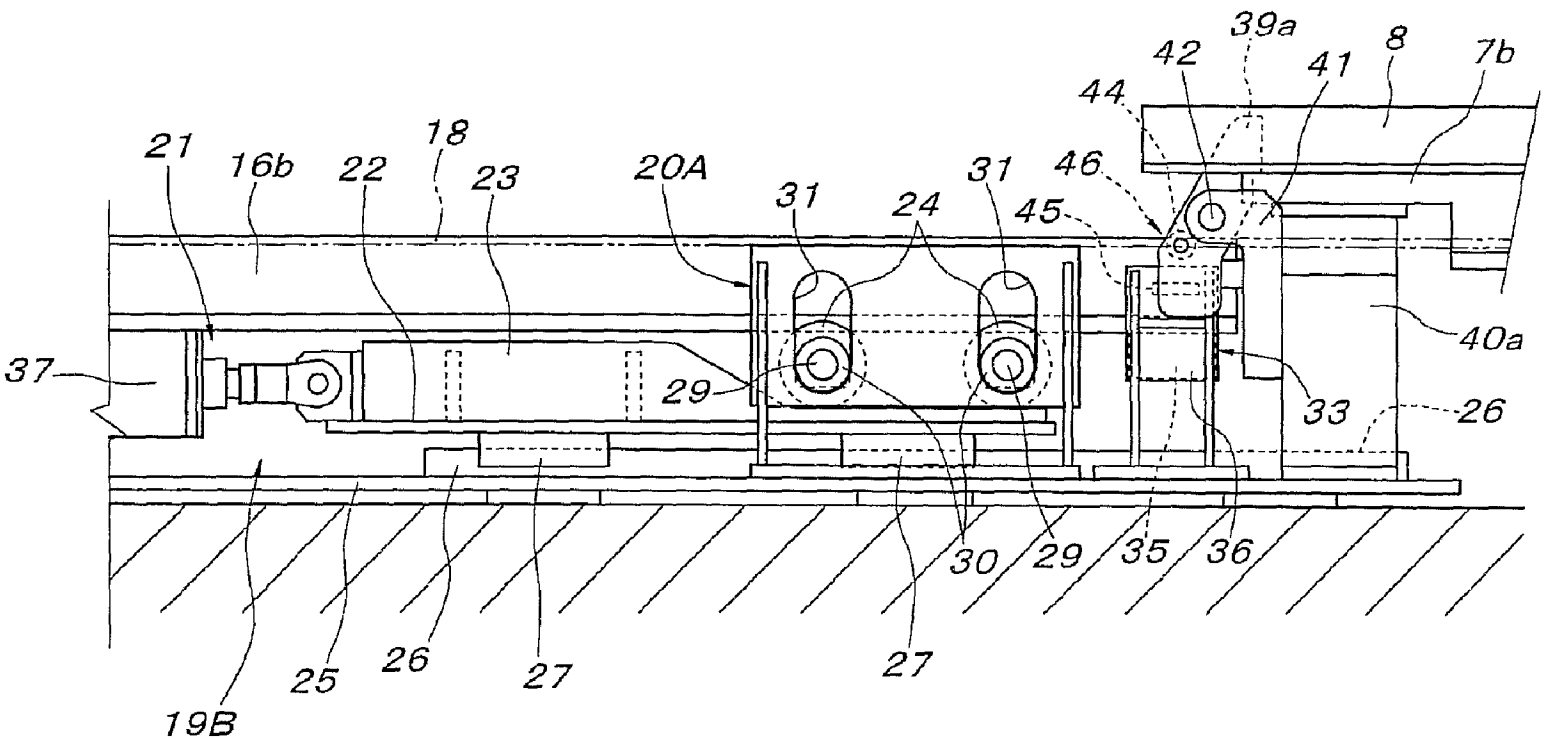
FIG. 10 is an enlarged side view of a main portion of FIG. 7B.
Figure 11:
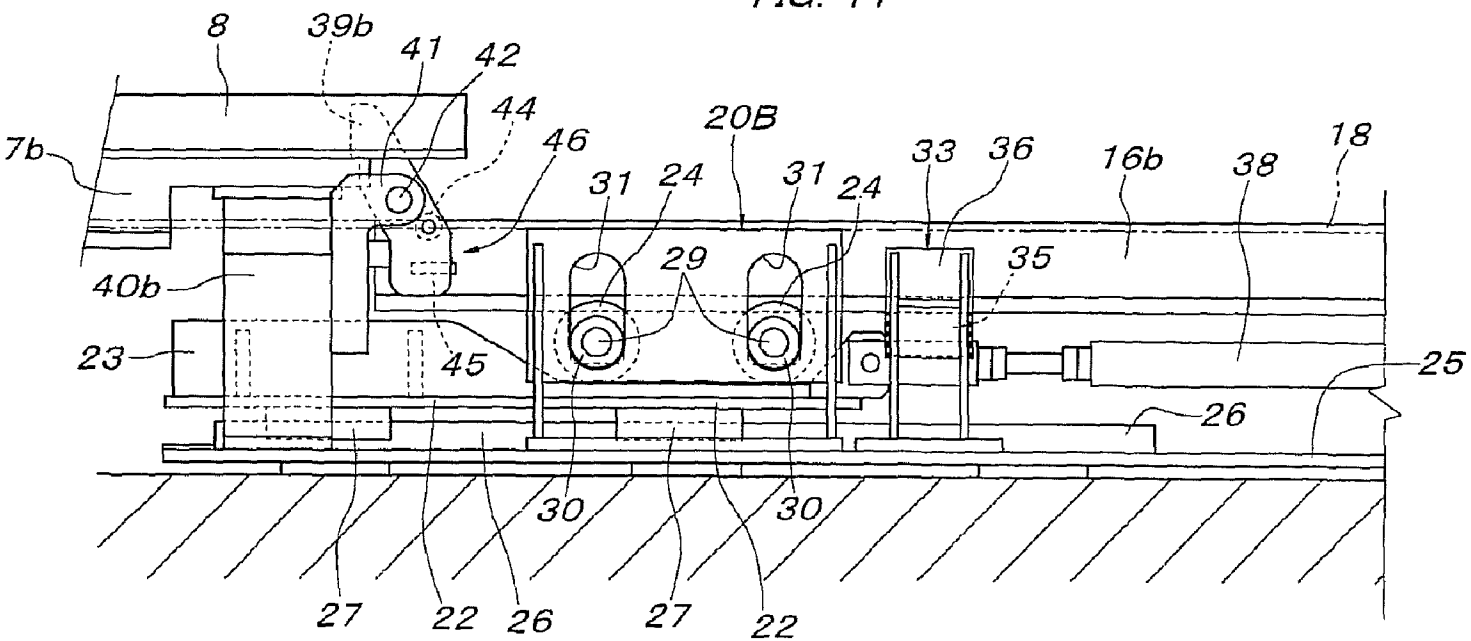
FIG. 11 is an enlarged side view of another main portion of FIG. 7B.
Figure 12:
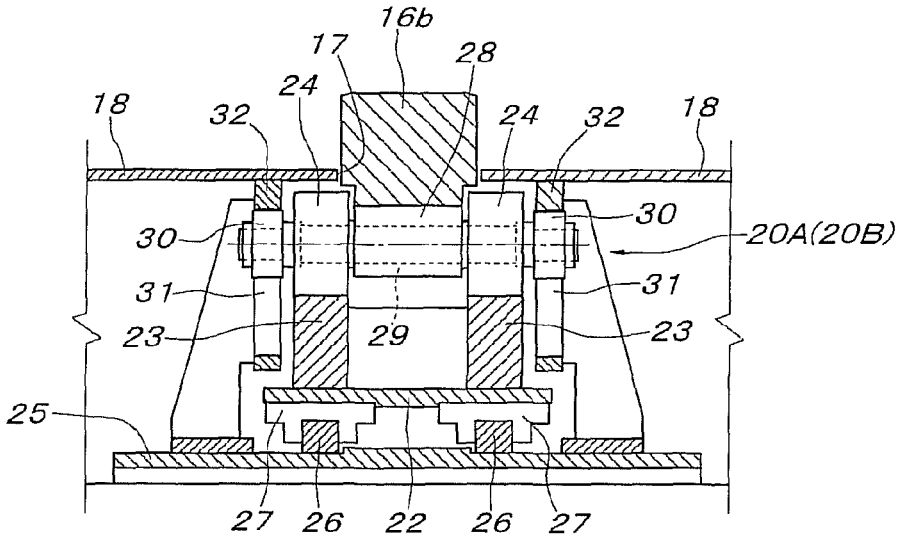
FIG. 12 is a longitudinal sectional front view of a main portion when the elevating guide rails are at the raised level.

When the conveyance carriage 1 traveling reaches a point at a predetermined distance to the aisle crossing section 14, the drive means 21 (cylinder units 37) of the elevating drive devices 19A and 19B is actuated to slide the cam rails 23 to the upstream side of the aisle crossing section 14 as shown in FIG. 2A, FIG. 3B, FIG. 4 through FIG. 6, FIG. 7A, FIG. 8, FIG. 9, FIG. 12, and FIG. 14 via the plate-shaped movable bodies 22 of both front and rear elevating support means 20A and 20B, whereby the elevating guide rails 16*a* and 16*b* are raised to the raised level from the lowered level. Specifically, switching is made into a state that the low-level horizontal support surfaces of the cam rails 23 of both front and rear elevating support means 20A and 20B support the cam follower rollers 24. As a result, the elevating guide rails 16*a* and 16*b* raised from the apertures 17 of the floor member 18 covering the pit 15 connect the guide rails 7*a* and 7*b* before and after the aisle crossing section 14 at the same level, and simultaneously, as shown in FIG. 8, FIG. 9, and FIG. 14, the operating plates 45 of the switching means 46 of the carriage stoppers 39*a* and 39*b* rise together with the elevating guide rails 16*a* and 16*b* and push up the cam follower rollers 44 of the carriage stoppers 39*a* and 39*b*, so that the carriage stoppers 39*a* and 39*b* are switched into a fallen-down nonworking posture and withdraw downward from the movement path of the vertical axis rollers 3*a* through 3*d* of the conveyance carriage 1. Therefore, the wheels 2 of the conveyance carriage 1 roll and move to the guide rails 7*a* and 7*b* on the downstream side of the aisle crossing section 14 through the elevating guide rails 16*a* and 16*b* at the raised level from the guide rails 7*a* and 7*b* on the upstream side of the aisle crossing section 14, and accordingly, the conveyance carriage 1 can pass through the aisle crossing section 14 without problems. At this time, as described above, at least two vertical axis rollers among the four vertical axis rollers 3*a* through 3*d* of the conveyance carriage 1 always fits, with play remaining, in the conveyance carriage guiding groove-shaped guide rails 8 before and after the aisle crossing section 14 when moving, so that the conveyance carriage 1 passing through the aisle crossing section 14 reliably travels straight, and there is no possibility that the orientation of the conveyance carriage 1 unexpectedly changes during passing through the aisle crossing section 14 and the wheels 2 come out of and fall off the elevating guide rails 16*a* and 16*b* and the guide rails 7*a* and 7*b* on the downstream side of the aisle crossing section 14 and the vertical axis rollers 3*a* through 3*d* do not fit in the conveyance carriage guiding groove-shaped guide rail 8 on the downstream side of the aisle crossing section 14 and come out of it.

When the conveyance carriage 1 is a type that is propelled by the frictional driving means 12, as shown by the imaginary lines in FIG. 1, the frictional drive means 12 is disposed front and rear adjacent to the aisle crossing section 14 so that the conveyance carriage 1 to be sent into the aisle crossing section 14 by the frictional drive means 12 on the upstream side of the aisle crossing section 14 is propelled successively by the frictional drive means 12 on the downstream side of the aisle crossing section 14 before separating from the frictional drive means 12 on the upstream side. Before the aisle crossing section 14, by providing the frictional drive means 12 which can temporarily stop the traveling conveyance carriage 1 and send it out to the aisle crossing section 14 at an arbitrary timing, the crossing aisle 13 can be used by temporarily stopping the conveyance carriage 1 before the aisle crossing section 14 and lowering the elevating guide rails 16*a* and 16*b* to the lowered level only when a vehicle, etc., passes through the crossing aisle 13.

In the illustrated embodiment, a wide pit 15 covering the entire aisle crossing section 14 is provided, however, it is also allowed that two narrow and long pits for housing only the elevating guide rails 16*a* and 16*b* and the elevating drive devices 19A and 19B separately are formed. It is also allowed that the cam follower rollers 24 are axially supported on the plate-shaped movable bodies 22 and the cam rails 23 are laid below the elevating guide rails 16*a* and 16*b*.

INDUSTRIAL APPLICABILITY

The carriage-type conveyance system according to the present invention can be used as a car body conveyance system in a car assembly line for attaching various parts to a car body while conveying the car body.

What is claimed is:

1. A carriage-type conveyance system using a conveyance path formed by supporting guide rails laid on a floor surface and a conveyance carriage which travels on the supporting guide rails in a traveling direction, and is provided with an aisle crossing section where an aisle on the floor surface crosses the conveyance path, comprising:

a pit formed in the floor surface of the aisle crossing section and the pit is covered by a floor member laid flush with the floor surface, elevating guide rails disposed inside the pit movably vertically parallel between a raised level at which they connect the supporting guide rails before and after the pit and a lowered level at which their upper surfaces are flush with the floor surface, elevating drive devices operable to elevate the elevating guide rails between the raised level and the lowered level, elevating apertures for the elevating guide rails formed in the floor member, the conveyance carriage having at least four guided portions at intervals in the traveling direction, conveyance carriage alignment guide rails disposed on the conveyance path before and after the aisle crossing section, and at least two of the guided portions always engaging the conveyance carriage alignment guide rails when the conveyance carriage passes through the aisle crossing section to maintain proper alignment of the conveyance carriage with the supporting guide rails as the conveyance carriage passes through the aisle crossing section, wherein in the conveyance path, a carriage stopper and a switching means are provided parallel, and where the carriage stopper is provided on at least the upstream side of the conveyance carriage traveling direction of the aisle crossing section, and is freely switched between a working posture in which the carriage stopper stops the conveyance carriage before the elevating guide rail and a nonworking posture in which it allows the conveyance carriage to pass through, and the switching means switches the carriage stopper into the working posture only when the elevating guide rail is at the lowered level in conjunction with the vertical movements of the elevating guide rail.

2. A carriage-type conveyance system using a conveyance path formed by supporting guide rails laid on a floor surface and a conveyance carriage which travels on the supporting guide rails in a traveling direction, and is provided with an aisle crossing section where an aisle on the floor surface crosses the conveyance path, comprising:

a pit formed in the floor surface of the aisle crossing section and the pit is covered by a floor member laid flush with the floor surface, elevating guide rails disposed inside the pit movably vertically parallel between a raised level at which they connect the supporting guide rails before and after the pit and a lowered level at which their upper surfaces are flush with the floor surface, elevating drive devices operable to elevate the elevating guide rails between the raised level and the lowered level, elevating apertures for the elevating guide rails formed in the floor member, the conveyance carriage having at least four guided portions at intervals in the traveling direction, conveyance carriage alignment guide rails disposed on the conveyance path before and after the aisle crossing section, and at least two of the guided portions always engaging the conveyance carriage alignment guide rails when the conveyance carriage passes through the aisle crossing section to maintain proper alignment of the conveyance carriage with the supporting guide rails as the conveyance carriage passes through the aisle crossing section, wherein the elevating drive devices include elevating support means and drive means, and where the elevating support means is disposed at least at two positions near the longitudinal ends of the elevating guide rails, and is constituted each by cam rails provided on either a movable body movable in the longitudinal direction of the corresponding elevating guide rail below the elevating guide rail, and a cam follower roller provided on the other, and the drive means is constructed so as to reciprocate the movable bodies of the elevating support means in conjunction with each other.

3. The carriage-type conveyance system according to claim 2, wherein each elevating guide rail is provided with a parallel elevating guide unit, and a pair of left and right cam follower rollers are axially supported concentrically on both left and right sides of the elevating guide rail, where the elevating guide unit is provided in at least two positions near the longitudinal ends of the elevating guide rail, and has a pair of left and right slide guides sandwiching the elevating guide rail, and each elevating support means is provided with elevating guide rollers and elevating guide members, where the pair of elevating guide rollers are axially supported on the left and right concentrically with the cam follower rollers on the outer sides of the pair of left and right cam follower rollers, the pair of left and right elevating guide members are provided parallel so that the pair of left and right guide rollers engage with the elevating guide members while being moved vertically, and the movable body is disposed between the pair of left and right elevating guide members, and on the movable body, a pair of left and right cam rails are laid which support the pair of left and right cam follower rollers, respectively.

4. A carriage-type conveyance system using a conveyance path formed by supporting guide rails laid on a floor surface and a conveyance carriage which travels on the supporting guide rails in a traveling direction, and is provided with an aisle crossing section where an aisle on the floor surface crosses the conveyance path, comprising:

a pit formed in the floor surface of the aisle crossing section and the pit is covered by a floor member laid flush with the floor surface, elevating guide rails disposed inside the pit movably vertically parallel between a raised level at which they connect the supporting guide rails before and after the pit and a lowered level at which their upper surfaces are flush with the floor surface, elevating drive devices operable to elevate the elevating guide rails between the raised level and the lowered level, elevating apertures for the elevating guide rails formed in the floor member, a carriage stopper and a switching means are provided parallel, in the conveyance path, the carriage stopper is provided on at least the upstream side of the conveyance carriage traveling direction of the aisle crossing section, and is freely switched between a working posture in which the carriage stopper stops the conveyance carriage before the elevating guide rail and a nonworking posture in which it allows the conveyance carriage to pass through, and the switching means switches the carriage stopper into the working posture only when the elevating guide rail is at the lowered level in conjunction with the vertical movements of the elevating guide rail.

5. A carriage-type conveyance system using a conveyance path formed by supporting guide rails laid on a floor surface and a conveyance carriage which travels on the supporting guide rails in a traveling direction, and is provided with an aisle crossing section where an aisle on the floor surface crosses the conveyance path, comprising:

a pit formed in the floor surface of the aisle crossing section and the pit is covered by a floor member laid flush with the floor surface, elevating guide rails disposed inside the pit movably vertically parallel between a raised level at which they connect the supporting guide rails before and after the pit and a lowered level at which their upper surfaces are flush with the floor surface, elevating drive devices operable to elevate the elevating guide rails between the raised level and the lowered level, elevating apertures for the elevating guide rails formed in the floor member, the elevating drive devices include elevating support means and drive means , the elevating support means is disposed in least at two positions near the longitudinal ends of the elevating guide rails, and is constituted each by cam rails provided on either a movable body movable in the longitudinal direction of the corresponding elevating guide rail below the elevating guide rail or the elevating guide rail, and a cam follower roller provided on the other, and the drive means is constructed so as to reciprocate the movable bodies of the elevating support means in conjunction with each other.

6. The carriage-type conveyance system according to claim 5, wherein the elevating guide rail is provided with an elevating guide unit parallel, and a pair of left and right cam follower rollers are axially supported concentrically on both left and right sides of the elevating guide rail, where the elevating guide unit is provided in at least two positions near the longitudinal ends of the elevating guide rail, and has a pair of left and right slide guides sandwiching the elevating guide rail, and each elevating support means is provided with elevating guide rollers and elevating guide members, where the pair of elevating guide rollers are axially supported on the left and right concentrically with the cam follower rollers on the outer sides of the pair of left and right cam follower rollers, the pair of left and right elevating guide members are provided parallel so that the pair of left and right guide rollers engage with these movably vertically, and the movable body is disposed between the pair of left and right elevating guide members, and on the movable body, a pair of left and right cam rails which support the pair of left and right cam follower rollers, respectively, are laid.

* * * * *